US009233036B1

(12) United States Patent
Frederick et al.

(10) Patent No.: US 9,233,036 B1
(45) Date of Patent: Jan. 12, 2016

(54) APPARATUS AND METHODS FOR PRESSURE RELEASE

(71) Applicants: Tracy Lee Frederick, Coarsegold, CA (US); Larry Dwayne Miller, Fresno, CA (US)

(72) Inventors: Tracy Lee Frederick, Coarsegold, CA (US); Larry Dwayne Miller, Fresno, CA (US)

( * ) Notice: Subject to any disclaimer, the term of this patent is extended or adjusted under 35 U.S.C. 154(b) by 102 days.

(21) Appl. No.: 13/771,857

(22) Filed: Feb. 20, 2013

Related U.S. Application Data

(60) Provisional application No. 61/602,002, filed on Feb. 22, 2012.

(51) Int. Cl.
*A61G 5/10* (2006.01)
*A61G 5/12* (2006.01)
*A61G 5/14* (2006.01)

(52) U.S. Cl.
CPC .. *A61G 5/12* (2013.01); *A61G 5/10* (2013.01); *A61G 5/1067* (2013.01); *A61G 5/14* (2013.01)

(58) Field of Classification Search
CPC ..... A61G 5/12; A61G 5/14; A61G 5/1067
USPC ..... 280/250.1, 290, 304.1
See application file for complete search history.

(56) References Cited

U.S. PATENT DOCUMENTS 635,683 A * 10/1899 Herman ..... 280/290
3,896,954 A * 7/1975 Dawson ..... 37/461
4,121,695 A * 10/1978 Carpenter ..... 414/539
4,530,122 A * 7/1985 Sanders et al. ..... 5/83.1
4,574,901 A * 3/1986 Joyner ..... 180/65.1
4,759,561 A * 7/1988 Janssen ..... 280/250.1
4,948,156 A * 8/1990 Fortner ..... 280/304.1
4,999,862 A * 3/1991 Hefty ..... 5/87.1
5,086,870 A * 2/1992 Bolduc ..... 180/333
5,165,123 A * 11/1992 Colpron ..... 5/83.1
5,333,333 A * 8/1994 Mah ..... 5/87.1
5,379,468 A * 1/1995 Cassidy et al. ..... 5/86.1
5,555,224 A * 9/1996 DePonty et al. ..... 368/10
5,569,129 A * 10/1996 Seif-Naraghi et al. ..... 482/69
5,975,826 A * 11/1999 Scholder ..... 414/444
6,003,171 A * 12/1999 Jones, Jr. ..... 4/667
6,481,694 B2 * 11/2002 Kozak ..... 254/325
6,619,681 B2 * 9/2003 Gutierrez ..... 280/250.1
6,679,510 B2 * 1/2004 Perena ..... 280/250.1
6,963,286 B2 * 11/2005 Marquis et al. ..... 340/666
7,111,338 B2 * 9/2006 Faux et al. ..... 5/81.1 HS
7,504,955 B2 * 3/2009 Overturf ..... 340/573.1

(Continued)

FOREIGN PATENT DOCUMENTS

GB 1368134 A * 9/1974 ..... A61G 5/00
WO WO 8906149 A1 * 7/1989 ..... A62B 35/00

*Primary Examiner* — Joseph Rocca
*Assistant Examiner* — Maurice Williams
(74) *Attorney, Agent, or Firm* — Andrew D. Fortney; Central California IP Group, P.C.

(57) ABSTRACT

A pressure release device and methods of using the same are disclosed. The pressure release device and/or related methods may be useful for alleviating and/or relieving pressure on skin tissue prone to developing pressure sores and/or tissue that has already developed pressure sores. The pressure release device generally includes one or more relays, logic configured to actuate the one or more relays, one or more motors, and a barrel rotatably connected to at least one of the motor(s) and having one or more straps retractably affixed thereto. Optionally, the pressure release device may be detachably or permanently connected to a surface or frame of a wheelchair.

20 Claims, 4 Drawing Sheets

(56) References Cited

U.S. PATENT DOCUMENTS

| | | | | |
|---|---|---|---|---|
| 8,607,378 | B2 * | 12/2013 | Moriarity et al. | 5/83.1 |
| 2003/0141692 | A1 * | 7/2003 | Perena | 280/250.1 |
| 2005/0104319 | A1 * | 5/2005 | Wing | 280/250.1 |
| 2008/0132383 | A1 * | 6/2008 | Einav et al. | 482/8 |
| 2008/0281144 | A1 * | 11/2008 | Cameron et al. | 600/12 |

* cited by examiner

APPARATUS AND METHODS FOR PRESSURE RELEASE

RELATED APPLICATIONS

This application claims the benefit of U.S. Provisional Application No. 61/602,002, filed Feb. 22, 2012, which is incorporated herein by reference in its entirety.

FIELD OF THE INVENTION

The present invention generally relates to the field of preventing pressure sores. More specifically, embodiments of the present invention pertain to methods and apparatuses for changing the position of a body and/or body part in the treatment and/or prevention of pressure sores.

DISCUSSION OF THE BACKGROUND

Pressure sores, also known as decubitus ulcers, pressure ulcers, and/or bedsores, are damage to areas of tissue commonly caused by continuous pressure on and/or decreased blood flow to the affected area. The shearing of tissue layers can also lead to the formation of pressure sores. Pressure sores commonly form in tissues that are in close proximity to bones. For example, the skin around heels, hips, sacrum, back, back of head, elbows, and/or ankles can be particularly susceptible to such injury. Once a pressure sore develops, a person is at risk for developing further complications and health injuries, such as sepsis and/or amyloidosis.

People who are restricted in their movement, such as the elderly, and those who are bedridden, in wheelchairs, or otherwise limited in their range of movement are at increased risk for developing pressure sores. Keeping a person's skin clean and dry has been known to decrease the chances of developing pressure sores. In addition, to decrease the risk and/or to prevent pressure sores, people with limited mobility are encouraged to continually change body positions at regular time intervals. For example, the nursing staff in a hospital may repeatedly turn or rotate a bedridden patient at a set time interval (e.g., every couple hours) to relieve pressure on injury-prone tissue areas of the patient. Other methods for preventing pressure sores include the use of mattresses that redistribute the pressure on skin areas prone to developing pressure sores. Similarly, pillows and/or cushions are used to redistribute the weight for people who are generally immobile, who sit and/or lie for long durations, and/or are wheelchair or bed bound.

In situations where a person is dependent upon a nurse or caretaker to change their body position, the caretaker may not always be able to move/adjust the person at a consistent time interval. For instance, the caretaker may be called upon to perform tasks elsewhere and unable to adjust the person at regular time intervals. Further, pressure-relieving cushions, pillows and mattresses may wear out, compress and/or otherwise lose their pressure-relieving efficacy over time. Moreover, the cost of specialized mattresses and regular nursing care may be cost-prohibitive.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

The present invention advantageously provides an apparatus and method that provides for a person and/or the person's body part to be moved at regular time intervals, and thereby provide for alleviating pressure and improving/returning blood flow to tissue areas that may be prone to developing pressure sores. Further, it is desirable to provide for moving a person and/or body part for a controlled and/or consistent time period (e.g., move the person or body part, allow the person or body part to remain in the moved position for a predetermined period of time, then return the person or body part to the original position.). Further, it is desirable to provide a pressure release system that is connected (detachably or permanently) to a wheelchair. Further still, due to the cost to have a caretaker or nurse provide constant pressure relief, it is desirable to provide an apparatus and method to provide regular pressure relief at consistent time intervals in a cost-effective manner.

Embodiments of the present invention generally relate to systems and methods for pressure release that advantageously provide for pressure relief on tissue areas that may be susceptible to developing pressure sores. More specifically, embodiments of the present invention relate to a pressure release device comprising a barrel rotatably having one or more straps retractably affixed thereto, one or more motors configured to rotate the barrel in a clockwise and/or counterclockwise direction, one or more relays configured to drive the motor, and logic configured to actuate and/or control timing of the one or more relays. In some instances, the logic may comprise a microcontroller. In other embodiments, the pressure release device may further comprise a 12-volt DC battery or a 24-volt to 12-volt converter. In further embodiments, each of the straps is bounded by strap guides. In still further embodiments, the pressure release device is connected (e.g., permanently or detachably) to a wheelchair or other mobility device or apparatus.

Further embodiments of the present invention may relate to a method of raising and lowering a body part, comprising attaching a harness to the body part, the harness being attached to one or more straps, the strap(s) being connected to a rotatable barrel connected to one or more motors, the one or more motors receiving a signal from one or more relays to rotate the barrel, the one or more relays receiving a control signal from logic configured to actuate the relay(s); causing the body part to move relative to its original position by automatically releasing or retracting the strap(s); waiting for a first predetermined period of time; and returning the body and/or body part to its original position (e.g., by retracting the strap(s)) using the motor.

The present invention advantageously alleviates adverse effects of continuous pressure on various body parts and returns blood flow to tissue areas that may be prone to developing pressure sores. These and other advantages of the present invention will become readily apparent from the detailed description of various embodiments below.

DETAILED DESCRIPTION

Figure 1:
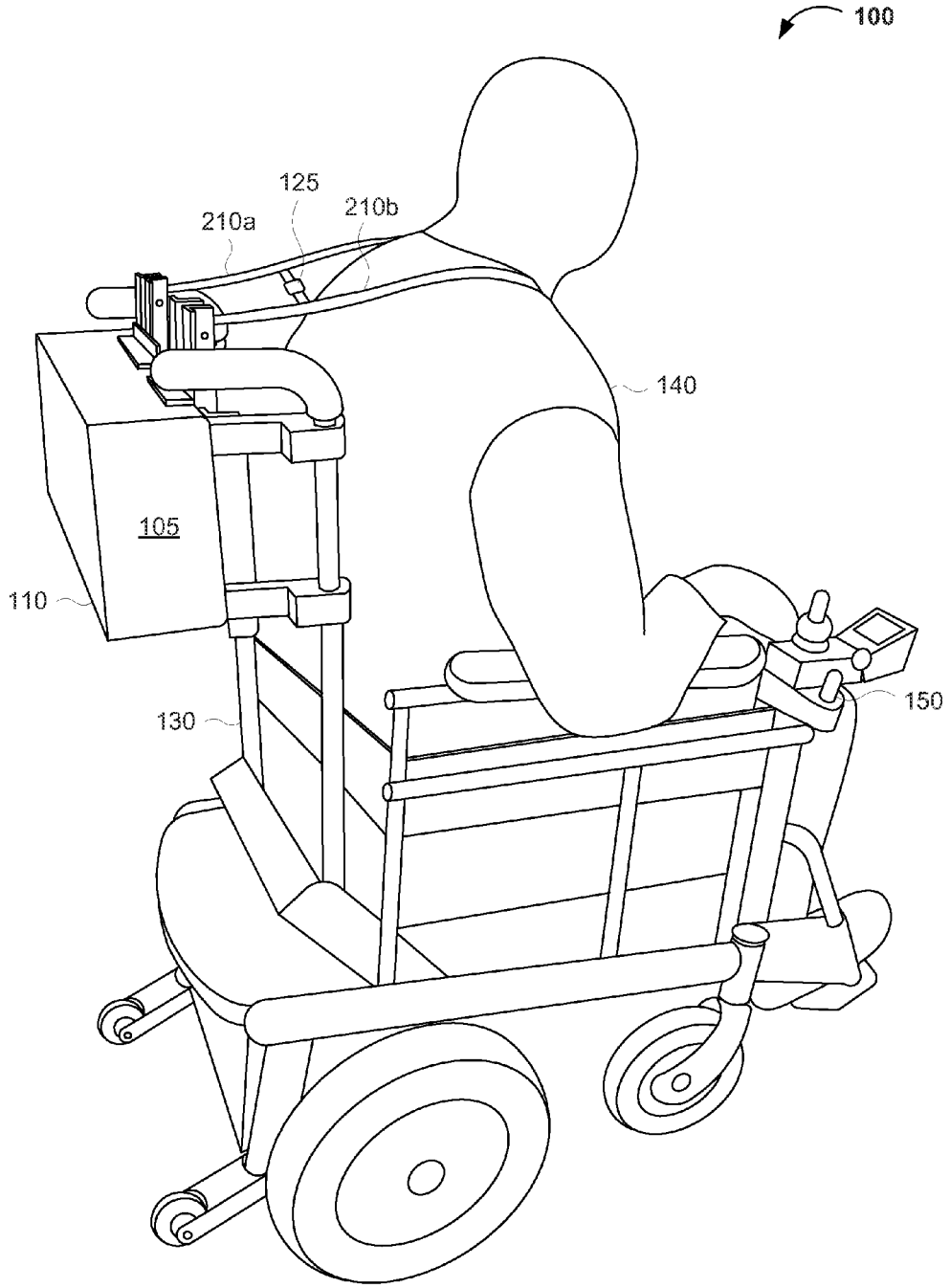
FIG. 1 shows an exemplary pressure release system.

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

For the sake of convenience and simplicity, the terms "pressure sores," "decubitus ulcers," "pressure ulcers" and "bedsores" are generally used interchangeably herein, but are generally given their art-recognized meanings. Also, for convenience and simplicity, the terms "body," "person," and "body part(s)" may be used interchangeably, as may the terms "connected to," "coupled with," "coupled to," and "in communication with," but these terms are also generally given their art-recognized meanings. Further still, for convenience and simplicity, the terms "wheelchair," "mobility device," and "motorized scooter" may be used interchangeably, but these terms are also generally given their art-recognized meanings.

The present invention concerns an apparatus and method for pressure relief. In particular, the method generally relates to moving a body and/or body part relative to its original position, waiting for a first period of time, and returning the body and/or body part to its original position. A further aspect of the invention concerns a pressure relief device generally comprising a barrel rotatably having one or more straps retractably affixed thereto, one or more servo motors configured to rotate said barrel in a clockwise and/or counterclockwise direction, one or more relays configured to drive said servo motor, and logic configured to actuate and/or control timing of the one or more relays.

Various embodiments and/or examples disclosed herein may be combined with other embodiments and/or examples, as long as such a combination is not explicitly disclosed herein as being unfavorable, undesirable or disadvantageous. The invention, in its various aspects, will be explained in greater detail below with regard to exemplary embodiments.

An Exemplary Pressure Release Device

In one aspect, the present invention relates to a pressure release device comprising a barrel rotatably having one or more straps retractably affixed thereto, one or more servo motors configured to rotate the barrel in a clockwise and/or counterclockwise direction, one or more relays configured to drive the servo motor(s), and logic configured to actuate and/or control timing of the relay(s).

Embodiments of the present pressure release device raise and lower a body and/or body part, such as a torso, one or more legs and/or one or more arms. For the sake of convenience and simplicity, embodiments of the present invention are described with respect to lowering and raising an upper torso. However, it will be readily understood by those skilled in the art that embodiments of the present invention can also be used in raising and lowering other body part(s), such as a person's legs and/or arms. Given that the range of motion of various extremities may differ, it will be readily understood by those skilled in the art that embodiments of the present invention may further include operating the pressure release device in any manner consistent with the purpose of the present invention. For example, to relieve pressure on a leg, pressure release device may generally retract the strap(s) to raise the leg, and thereafter release the strap(s) to return the leg to its original position.

Referring now to FIG. 1, a first exemplary embodiment of a pressure release device 110 is detachably connected to a wheelchair 130. In one embodiment, pressure release device 110 may generally comprise a housing, enclosure and/or exterior 105. Straps 120*a* and 120*b* are connected to pressure release device 110 and are either detachably connected to a harness (not shown) or function as a harness, to secure the person 140 safely in the wheelchair 130. As pressure release device 110 releases a predetermined length of the straps 120*a* and 120*b*, at least the upper portion (e.g., the chest, shoulder and head areas) of the person 140 is lowered. After an amount of time, either predetermined (e.g., every 45 minutes) or at the will of the user (e.g., person 140), the pressure release device 110 retracts straps 120*a* and 120*b* and returns the person 140 to an upright position. Raising and lowering the upper torso of the person 140 releases pressure in the person's lower body and increases blood flow to various tissues therein. For example, the pressure release device 110 provides for release of pressure on tissues around and increased blood flow to and including the hips, coccyx bone, lower back, upper legs, etc. Raising and lowering the person 140 using pressure release device 110 will aid in the prevention and/or treatment of pressure sores.

The pressure release device may have any suitable dimensions to accommodate the components of the pressure release device. Further, the pressure release device may have any suitable dimensions to fit any type of mobility device, such as a wheelchair and/or scooter. In one embodiment, the pressure release device may generally have dimensions of 8" (height)× 4" (depth)×19" (width), although any height of 2" to 18", any depth from 1" to 8", and any width from 6" to 24" may be acceptable. The cavity for holding some or all of the components of the pressure release device may be slightly less than the overall dimensions of the pressure release device.

Further, the pressure release device may be releasably or permanently affixed to the mobility device using any combination of brackets, beams, and fasteners. For example, the pressure release device may be detachably connected to a wheelchair using one or more arms extending from the pressure release device and affixed to the wheelchair using one or more brackets secured to the wheelchair using bolts and/or nuts. A similar mounting arrangement may be used to permanently affix the pressure release device to the pressure release device, but in which the mechanism is not detachable. For example, the pressure release device could be affixed to a wheelchair using rivets and/or tamper-proof bolts. In another embodiment, the pressure release device may be releasably or permanently affixed to the wheelchair directly. For example, the pressure release device may be directly bolted or welded onto the wheelchair frame.

Figure 2:
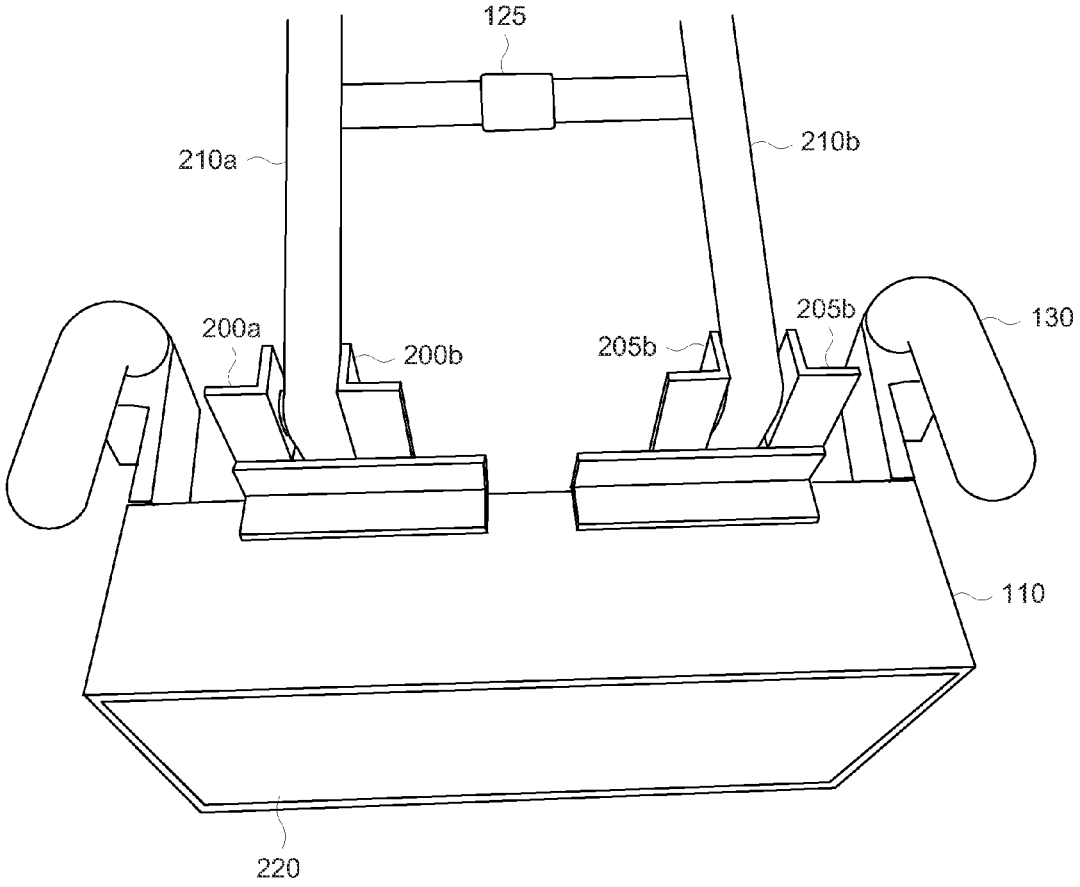
FIG. 2 is a top-down view of the exemplary pressure release system.

FIG. 2 is a top-down view of the pressure release device 110 affixed to wheelchair 130. In one embodiment, the straps 210*a* and 210*b* of the pressure release device 110 travel along risers 200*a-b* and 205*a-b* fitted with one or more axles or rollers between the opposing L-shaped sides of the riser. In general, there is one riser per strap, so if there is one strap, then there is one riser (at most). In one embodiment, each of the risers 200*a-b* and 205*a-b* comprises two generally vertical sides and a roller, axle, barrel or cylinder connected between the two sides on which the strap rests or moves. Each side of the riser (e.g., 200*a*) may generally be L-shaped, one part of which is attached to the wheelchair (e.g., by a nut-and-bolt attachment mechanism) and the other side (facing the other side of the riser) is attached to the roller, axle, or cylinder. Each riser may further contain a second roller, axle, barrel, or cylinder. Each riser may comprise wood, plastic, metal, or any combination thereof. Further, the gap or space between sides of the riser(s) may have generally the same or slightly greater width as one of the strap(s) (e.g., 210*a* or 210*b*).

The straps 210*a* and 210*b* may comprise any material that is durable and/or suitable for supporting the weight of a body part. For example, the straps 210*a* and 210*b* may comprise nylon, leather, paracord, or any combination thereof. Further, the length of the straps 210*a* and 210*b* can be any suitable length for raising and lowering a body and/or body part. In various embodiments, the straps 210*a* and 210*b* are each from 2 feet to 4 feet long. In one embodiment, the pressure release device 110 has a first strap 210*a* and a second strap 210*b*, configured to be placed over a person's shoulders and function as opposite sides of a harness, and a third strap 125 attached to the first and second straps 210*a* and 210*b*. In another embodiment, the third strap 125 is adjustably and/or releasably connected to the first and second straps 210*a* and 210*b*. In one embodiment, pressure release device 110 comprises at least two straps (e.g., 120*a* and 120*b*) and a third strap 125 attached across the two straps. Strap 125 may enable consistent spacing between the one or more straps (e.g., 120*a* and 120*b*). For example, strap 125 may prevent one or both straps 120*a* and 120*b* from sliding off the person 140 during use. In another embodiment, the strap 125 is adjustable and/or releasable.

In one embodiment, pressure release device 110 further comprises a cover, hatch and/or door 220. The cover 220 may comprise wood, plastic, metal, or any combination thereof. Cover 220 may be releasably and/or hingedly attached to the housing 305 of pressure release device 110 using any suitable mechanism such as screws, snaps, tabs, brackets, clasps and the like. The ability to remove or open cover 220 may provide for access to the internal components of pressure release device 110. The ability to access the internal components of pressure release device 110 may provide for the ability to repair and/or replace such components (e.g., replace a battery) and/or to program the pressure release device 110 (e.g., configure logic 320, shown in FIG. 3). In some embodiments, the cover 220 may be securely and/or permanently affixed to pressure release device 110. In this way, access to the internal components of pressure release device 110 may be restricted or prevented. For example, cover 220 may be securely and/or permanently attached to pressure release device 100 when access to the components of pressure release device 110 would pose a safety risk to the person.

The pressure release device may comprise generally a housing, motor(s), relay(s), logic, and a barrel connected to the motor and having one or more straps affixed thereto. In various embodiments, the logic may be configured to actuate the relay(s), control timing, and/or configured to receive input from a person. In one embodiment, the pressure release device may comprise a partition that supports the motor and barrel. In another embodiment, the pressure release device may generally further comprise a flange bearing supporting an end of the barrel.

Figure 3:
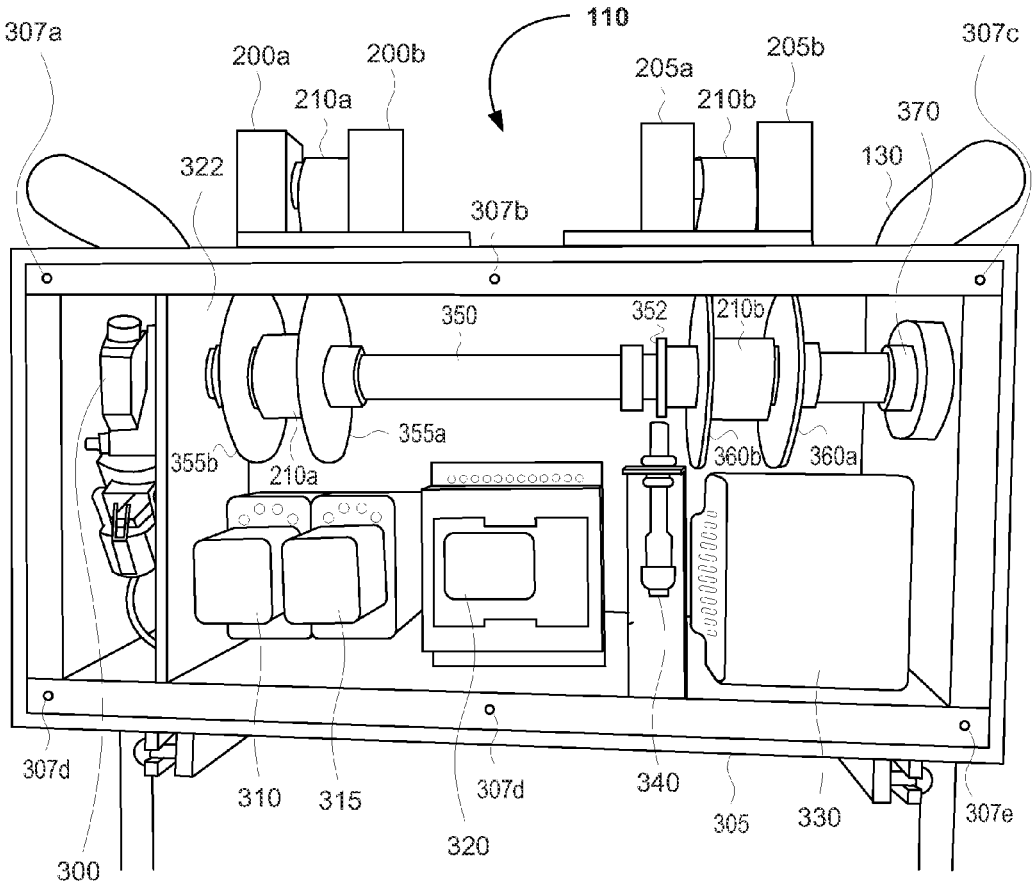
FIG. 3 is a view of the internal components of the pressure release system.

FIG. 3 illustrates exemplary components suitable for use in pressure release device 110 in accordance with embodiments of the present invention. Pressure release device 110 may comprise generally a housing 305, generally a servo motor 300, generally relays 310 and 315, generally programmable logic control/computer 320 configured to actuate the relays 310 and 315, and a barrel 350 connected to the servo motor 300 and having generally straps 210*a* and 210*b* affixed thereto. In one embodiment, the housing 305 of pressure release device 110 may comprise holes 307*a-e* for affixing cover 220 to the housing 305. In one embodiment, pressure release device 110 may comprise partition 322 that supports the servo motor 300 and the barrel 350. In another embodiment, the pressure release device 110 may generally further comprise a flange bearing 370, supporting an end of the barrel 350 and allowing rotational movement of the barrel 350.

In a further embodiment, the straps 210*a* and 210*b* of pressure release device 110 may travel along risers 200*a-b* and/or 205*a-b*. The risers 200*a-b* and/or 205*a-b* may be detachably or permanently connected to pressure release device 110 or wheelchair 130. Further, each of the risers 200*a-b* and/or 205*a-b* may include adjustable one or more barrels or rollers, the height of which may be adjusted using one or more bolt-and-wing nut mechanisms. Adjustable riser(s) 200*a-b* and 205*a-b* may be raised or lowered in any manner consistent to ensure proper operation of pressure release device 10 and/or comfort for the person 140.

The housing 305 of pressure release device 110 and cover 220 may comprise wood, plastic, metal, or any combination thereof. In one embodiment, housing 305 comprises one or more openings sufficient to allow the one or more straps (e.g., 210*a* and 210*b*) to travel between the barrel 350 and the riser (e.g., 200*a-b* in FIG. 2), and thus raise and lower a body and/or body part. The opening(s) may further include one or more plastic covers, rollers, barrels and/or any combination thereof sufficient to prevent binding and/or fraying of the strap(s).

In one embodiment, either upon manual input or at a predetermined time, the logic 320 actuates a first relay 310 to provide forward release of the straps 210*a* and 210*b*. As the strap(s) 210*a* and 210*b* are released, the person 140 (FIG. 1) changes positions. For example, the upper torso of the person 140 leans forward. At a predetermined point, the release of the straps 210*a* and 210*b* ceases (FIG. 3). After a predetermined amount of time, the logic 320 actuates a second relay 315, which activates the servo motor 300 to rotate the barrel 350, causing the straps 210*a* and 210*b* to retract. In another embodiment, the single relay provides both release and retraction of the straps 210*a* and 210*b*. In a further embodiment, logic (e.g., a microcontroller) drives servo motor 300 and optional barrel stop 340 directly, or optionally, through a voltage converter. As the straps 210*a* and 210*b* retract, the person 140 is returned to an upright position.

In other embodiments, the programmable logic control/computer 320 may comprise a microcontroller. In various embodiments, the logic (e.g., microcontroller) may be programmed to release or retract the straps every 15 to 90 minutes (e.g., every 30 to 60 minutes, or any time period or range there between). In one example, the straps are released or retracted about every 45 minutes. After the release or retraction of the straps, the logic may be further configured to then return the straps to their original position after a predetermined delay. In most instances, the predetermined delay is from 30 to 120 seconds. In one example, the predetermined delay is about 45 seconds. In general, but not necessarily, the shorter the time period between successive strap releases and/or strap retractions, the shorter the predetermined delay.

In one embodiment, the logic 320 may comprise one or more timers. For example, a first timer may be configured to expire at a predetermined time, such as every 30 to 90 minutes. Upon expiration of the timer, the logic 320 is configured to release and/or retract the straps (or actuate the relay to do so). Thereafter, the logic 320 is configured to return the straps to their original position (or actuate the relay to do so) after a second timer counts down (or up) an amount of time equal or equivalent to the predetermined delay. The first timer may start a new timing cycle at the end of its cycle, or at the end of the second timer's cycle (i.e., when the straps return to their original position.)

The logic may further comprise a programmable time-incremented cycle reminder. The programmable time-incremented cycle reminder may consistently remind the user at predetermined time intervals when to operate a cycle of the pressure release device 110. For example, the cycle may generally include the steps of releasing or retracting the straps, waiting for a period of time, then returning the straps to their original position. In another embodiment, the programmable time-incremented cycle reminder may automatically begin a pressure relief cycle of the pressure release device 110. It may be possible to configure logic 320 using an interface on cover 220 or elsewhere on or in the pressure release device 110. In alternate embodiments, it may be possible to configure the logic 320 using a wired connection to a computer (e.g., using a USB or other cable) and/or by using a wireless device (e.g., a smart phone with a logic programming application installed on it).

Logic 320 may also be programmed with any number of safety/backup procedures. In one embodiment, logic 320 may be programmed so that if a switch, button or other input method (e.g., switch 150 in FIG. 1) is engaged for a predetermined amount of time (e.g., 1-5 seconds), then the motor will retract the straps and return person to their original (e.g., upright) position. This feature may be particularly desirable in situations where a person is unable to lift themselves back to their original position on their own.

In an alternate embodiment, pressure release device 110 comprises one relay. In one embodiment, the servo motor(s) (e.g., motor 300 in FIG. 3) comprise a DC reversible servo motors. It will be readily understood by those generally skilled in the art that servo motor 300 can be any type of motor suitable for releasing and/or retracting the straps. While a preferred embodiment of the present invention may utilize one or more servo motors, it will be readily understood by those generally skilled in the art that one or more stepper motors may also be used.

In still further embodiments, the pressure release device may comprise an encoder. Referring to FIG. 3, pressure release device 110 may comprise encoder 340. For example, the encoder 340 may be configured to provide information about the motion of barrel 350, such as speed, distance, position, etc., to the logic 320. In one embodiment, a belt (e.g., a flat belt) is rotatably connected to encoder 340 and barrel 350. As barrel 350 rotates, the belt turns encoder 340, which registers each turn as a count and sends the count to logic 320. In another embodiment, encoder 340 may be directly connected to barrel 350. In yet another embodiment, encoder 340 may comprise a proxy switch, such as a photo eye and/or magnetic pick up, capable of sending a signal (e.g., regarding the number of rotations of barrel 350) to logic 320. For example, encoder 340 may be configured to utilize sprocket 352 to determine information about the motion of barrel 350. In one embodiment, encoder 340 comprises a photo eye that "sees" a target (e.g., one or more cogs on sprocket 352 and/or an identifier on barrel 350) and counts each time the target passes the photo eye. In another embodiment, encoder 340 comprises a magnetic pick up that receives a signal from the one or more cogs on sprocket 352 as barrel 350 rotates.

In further embodiments, pressure release device 110 may comprise an alarm. The alarm can be configured notify a person of various events. For example, the alarm may notify a person to commence a pressure release cycle at a predetermined time (e.g., every 30 minutes), that a pressure release cycle will automatically commence, and/or that a predetermined interval of the pressure release cycle is complete or about to be completed (e.g., just prior to release and/or retraction of the straps). The alarm may comprise any suitable visual and/or audible cue. For example, the alarm may be a short, audible beep to indicate that pressure release device 110 will commence or has commenced a function, such as releasing or retracting the strap(s).

In a further embodiment, the pressure release device may comprise a voltage converter configured to convert a first voltage (e.g., from the battery) to a second voltage (e.g., for the servo motor) and optionally, to a third voltage (e.g., for the logic). In one embodiment, the voltage converter may be a 24 volt to 12 volt step-down transformer. For example, the voltage converter may enable the pressure release device 110 to utilize power from the power supply or battery of a motorized wheelchair. Referring to FIG. 3, the pressure release device 110 may comprise voltage converter 330.

In another embodiment, the pressure release device 110 may further comprise a battery (not shown). For example, the battery may be a DC battery. In one embodiment, the battery has a voltage of at least 12 volts, and in one example, 24 volts. Pressure release device 110 may further comprise a battery status indicator. For example, the battery status indicator may provide information about the amount of charge remaining in the battery. In another embodiment, pressure release device 110 may draw power from a battery configured to power the wheelchair.

In yet another embodiment, a harness (not shown) may be attached to the strap(s). The harness can be any suitable configuration for supporting a person, torso, and/or body extremity (e.g., an arm and/or leg). Further, the harness may be padded. In yet further embodiments, the adjustable and/or releasable strap 125 may facilitate placing the strap(s) (e.g., 120*a* and 120*b*) and/or harness on the person 140 and/or allow adjustments to the strap(s) or harness to provide a comfortable fit for the person 140. In another embodiment, the strap(s) and/or harness(es) may include any number of suitable release mechanism(s), such as buckles, clips, snaps, etc., or combinations thereof. In yet another embodiment, the release mechanism(s) may be any configuration suitable to allow for ease of engagement and disengagement. Such ease of use is important to provide easy access for the user, but also in case of emergency, the person can remove the one or more straps and/or harnesses.

In another embodiment, the pressure release device may comprise one or more strap guides proximate to the barrel, through which a strap is fed or retracted. Referring to FIG. 3, pressure release device 110 may comprise strap guides 355*a-b* and/or 360*a-b* on or proximate to barrel 350. A strap 210*a* or 210*b* is fed or retracted through a respective strap guide 355*a-b* or 360*a-b*. As barrel 350 rotates, each of the strap guides 355*a-b* and 360*a-b* may ensure that each of the straps 210*a* and 210*b* are wrapped about barrel 350 in an organized fashion and do not become tangled or haphazardly wrapped about barrel 350.

An Exemplary Mobility Device Including the Exemplary Pressure Release Device

In another embodiment, a mobility device (e.g., a wheelchair 130 as shown in FIG. 1) may comprise the present pressure release device, detachably or permanently connected to a surface or frame of the mobility device, and a battery (not shown) mounted or affixed to the mobility device, configured to provide power to the mobility device and the pressure release device. It will be readily understood by those generally skilled in the art that the pressure release device can be attached to any type of mobility device, such as a motorized scooter, and is not strictly limited to just a wheelchair. Further, the pressure release device may be operable using a switch (e.g., switch 150 in FIG. 1) connected permanently or detachably to wheelchair 130 and electrically connected (e.g., through a copper wire) to the pressure release device.

In another embodiment, the pressure release device may receive power from an internal battery and/or from a power supply for the motorized wheelchair or other powered mobility device. In further embodiments, the powered mobility device may comprise a voltage converter configured to power components of the pressure release device or other operational features of the mobility device (e.g., the motor driving the wheel[s] of a wheelchair) from the power supply of the powered mobility device.

Referring back to FIG. 1, the wheelchair 130 may comprise a switch 150 configured to operate and/or electrically disconnect the pressure release device 110. In one embodiment, the switch is located on an armrest of wheelchair 130. The switch 150 may be configured to include a plurality of settings that are communicated to pressure release device 110. In one embodiment, switch 130 may include settings which correspond to lowering and raising a person and/or body part a predetermined distance. For example, switch 110 may have a "full" setting which will operate pressure release device 110 through a full range of motion and/or a "half" setting which will operate pressure release device 110 through a half range of motion. For example, selecting "full" using the switch may lower a person to a bent over position (e.g., where the upper torso is at an angle of from 135°-180° with respect to the person's upper legs) while selecting "halfway" may position the person in a leaning position that is roughly halfway towards the bent over position. It will be readily understood by those in the art that the switch may include a number of other settings relating to raising and lowering a person and/or body part any portion of the full range of possible motion.

An Exemplary Method of Moving and Returning a Body Part

The present invention further relates to method of moving and returning (e.g., raising and lowering) a body part. Specifically, the method of raising and lowering a body part may comprise attaching a harness to the body part, the harness being attached to one or more straps, causing the body part to move relative to its original position by automatically releasing or retracting the strap(s), waiting for a first predetermined period of time, and returning the body and/or body part to its original position using the motor(s). The strap(s) are connected to a rotatable barrel rotated by one or more motors (e.g., a DC reversible servo motor). The motor(s) receive a signal from one or more relays to rotate the barrel, and the relay(s) receive a control signal from logic configured to actuate the relay(s).

Figure 4:
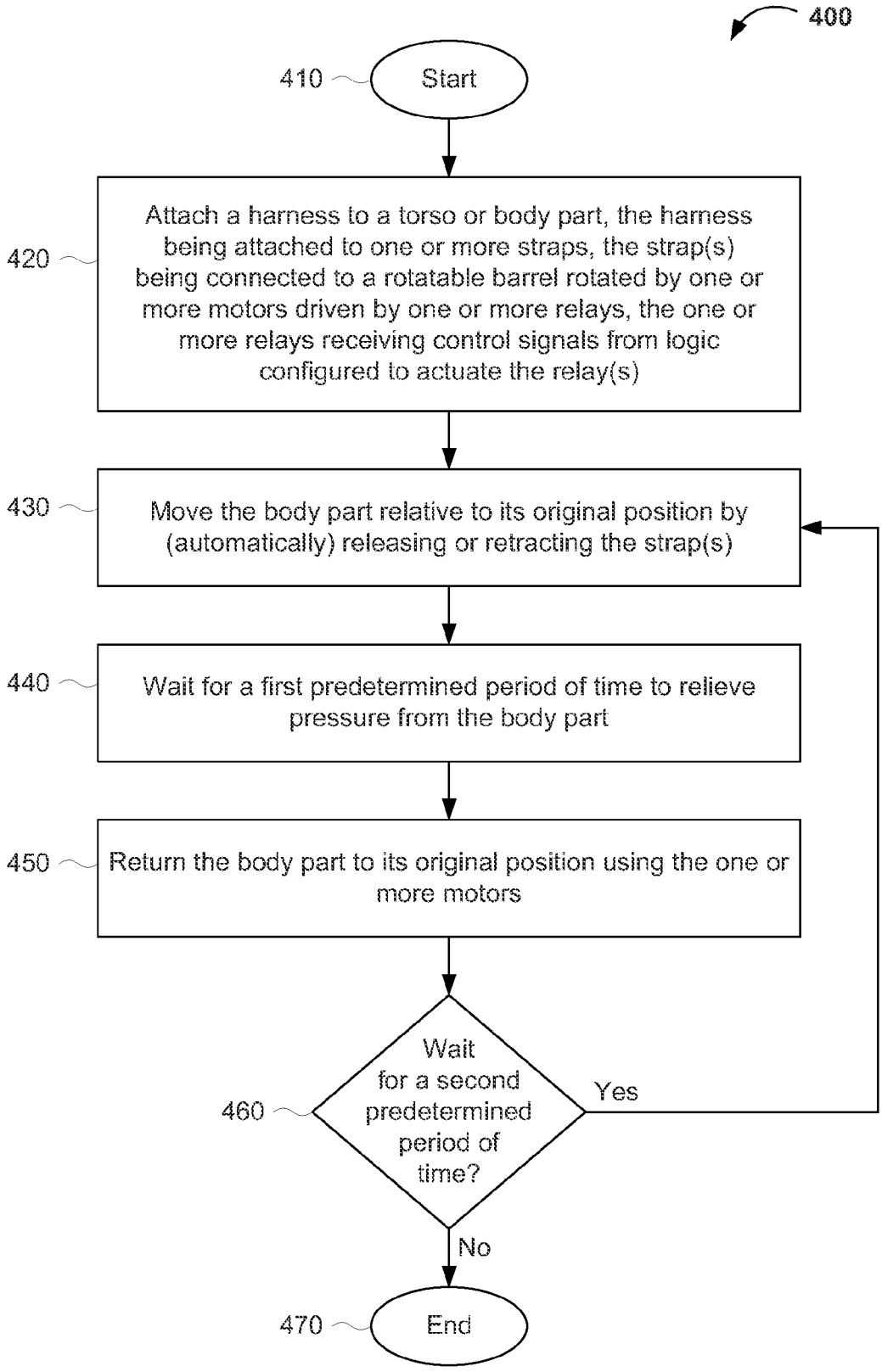
FIG. 4 is flow chart showing an exemplary method for raising and lowering a body part according to embodiments of the present invention.

Flow chart 400 of FIG. 4 illustrates a method of raising and lowering a body and/or body part according to the present invention. The method encompasses a single pass through part or all of the flow, although, it also involves a continuous process involving multiple cycles through the loop in the flow. For example, in the method, upon attaching the harness, the person or body part may be moved at regular intervals until the automated pressure release device is stopped (e.g., the person or body part is removed from the harness and/or the switch turns off the pressure release device).

Thus, the method may begin at 410, and at 420, the method comprises attaching a harness to a body part (e.g., a torso), the harness being attached to one or more straps. In one embodiment, the harness is formed at least in part (and optionally in its entirety) by the straps. The strap(s) are connected to a rotatable barrel, in turn connected to one or more motors (e.g., a DC reversible servo motor). The motor(s) receive a signal from one or more relays to rotate the barrel. The relay(s) receive a control signal from logic configured to actuate said one or more relays. For example, there may be one relay per direction (e.g., clockwise or counterclockwise) in which the barrel rotates. Alternatively, there may be only one relay. In a further alternative, there is no relay, and the motor direction is controlled by the logic. In one example, at 420, one or more straps and/or a harness may be attached to a person (e.g., person 140 in FIG. 1), wherein the strap(s) are pre-attached to a rotatable barrel in the pressure release device.

At 430, the body part is moved relative to its original position by releasing or retracting the strap(s). The strap(s) may be released or retracted automatically or on demand. For example, referring to FIG. 3, the straps 210*a* and 210*b* may be automatically released by the pressure release device 110 when a timer in (or controlled by) the programmable logic/computer 320 expires, and programmable logic/computer 320 actuates one of the relays 310 or 315. In an alternate embodiment, the user can press, pull, push, or otherwise activate a switch (e.g., 150 in FIG. 1) to actuate relay 310 or 315.

At 440, the method waits for a first predetermined period of time before returning the body or body part to its original position. During the first predetermined period of time, the body or body part remains in the moved position. The change in the position of the person's body may relieve and/or redistribute pressure on various tissues of the body and/or body part, and increase blood flow. In various embodiments, the first predetermined period of time is 30-120 seconds (e.g., 45-90 seconds).

At 450, the method returns the body and/or body part to its original position. When the body or body part is moved by releasing the strap(s), the method retracts the strap(s) at 450 using the motor(s). When the body or body part is moved by retracting the strap(s) using the motor(s), the method releases the strap(s) at 450. For example, referring to FIG. 3, the logic 320 actuates a second relay 315, and servo motor 300 rotates barrel 350, causing the straps 210*a* and 210*b* to retract. As the straps 210*a* and 210*b* retract, the person 140 is returned to an upright position.

At 460, the method waits for a second predetermined period of time before returning and repeating steps 430, 440 and 450. The second period of time can be any number of minutes or hours. In one embodiment, the second period of time is about 15-90 minutes (e.g., 45 minutes). As will be readily understood by one skilled in the art, the flow 400 can loop any number of times through steps 430-460.

At 470, the method ends. For example, the method may end when a switch (e.g., 150 in FIG. 1) is turned off, for example before removing the body or body part from the straps and/or harness, or when the person elects not to continue the flow after the body and/or body part is returned to its original position at 450.

CONCLUSION/SUMMARY

Thus, the present invention provides an apparatus and method for relieving pressure from one or more body parts.

Embodiments of the present invention advantageously provide pressure release for various body tissues by raising and/or lowering a body part at consistent, regular time intervals. According to the present invention, the method may comprise attaching a harness to the body part, the harness being attached to one or more straps, the straps being connected to a rotatable barrel connected to one or more servo motors, the one or more servo motors receiving a signal from one or more relays to then rotate the barrel, the one or more relays receiving a control signal from logic configured to actuate the one or more relays; causing the body part to move relative to its original position by automatically releasing or retracting the strap(s); waiting for a first predetermined period of time; and returning the body and/or body part to its original position using the one or more motors. Embodiments of the present invention also include a pressure release device comprising a barrel rotatably having one or more straps retractably affixed thereto, one or more servo motors configured to rotate the barrel in a clockwise and/or counterclockwise direction, one or more relays configured to drive the servo motor, and logic configured to actuate and/or control timing of the one or more relays. Further, the present invention can also be applied to any number of suitable objects, such as a stationary chair, bed frame (e.g., having a suitably sturdy head or foot), etc.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A pressure release device, comprising:

a) a barrel rotatably having one or more straps retractably affixed thereto;

b) one or more motors configured to rotate said barrel in a first direction to release a predetermined length of said one or more straps and a second direction to retract said one or more straps;

c) a harness attached to said one or more straps;

d) at least one riser between said barrel and harness, each riser having opposing sides and at least one axle or roller therebetween, each of the one or more straps in contact with said at least one axle or roller;

e) one or more relays configured to drive said motor; and f) logic configured to actuate and/or control timing of the one or more relays wherein said pressure release device is attachable to a rear portion of a wheelchair or a chair, and said one or more straps are configured to move an occupant's torso between an upright position and a lower bent-over position.

2. The pressure release device of claim 1, wherein the logic comprises a microcontroller.

3. The pressure release device of claim 1, wherein the logic is programmed to release or retract the one or more straps every 15 to 90 minutes, and then return the one or more straps to an original position after a predetermined delay.

4. The pressure release device of claim 3, wherein the predetermined delay is from 30 to 120 seconds.

5. The pressure release device of claim 1, wherein the logic further comprises a programmable time-incremented cycle reminder.

6. The pressure release device of claim 1, wherein the one or more motors comprise at least one DC reversible servo motor.

7. The pressure release device of claim 1, wherein the one or more straps comprise at least a first strap and a second strap, configured to be part of or attached to opposite sides of said harness configured to securely move a person or a body part.

8. The pressure release device of claim 1, further comprising a battery configured to supply power to the one or more motors, the one or more relays, and/or the logic.

9. The pressure release device of claim 8, further comprising a voltage converter configured to convert a first voltage from the battery to a second voltage for the motor and/or a third voltage for the logic.

10. The pressure release device of claim 1, further comprising one or more strap guides on or proximate to the barrel, through which the one or more straps are fed or retracted.

11. The pressure release device of claim 1, further comprising a controller and/or switch configured to operate the pressure release device.

12. The pressure release device of claim 1, further comprising an alarm configured to indicate an upcoming and/or actual release and/or retraction of the one or more straps.

13. A wheelchair, comprising the pressure release device of claim 1 connected to a surface or frame of the wheelchair, and a battery mounted or affixed to the wheelchair, configured to provide power to the wheelchair and/or the pressure release device.

14. The wheelchair of claim 13, further comprising a switch on an armrest of the wheelchair, and configured to include a plurality of settings for operating the pressure release device.

15. The pressure release device of claim 1, wherein the one or more straps comprise at least a first strap and a second strap configured to function as a harness, and a third strap attached to the first and second straps.

16. The pressure release device of claim 1, wherein each of the one or more straps comprises a first end attached or affixed to said barrel and a second end attached to said harness, and each of the one or more straps contacts a unique one of the at least axle or roller between opposing L-shaped sides of the riser.

17. A method of raising and lowering a body part, comprising:

a) attaching a harness to the body part, the harness being attached to one or more straps, the one or more straps being connected to a rotatable barrel connected to one or more of a pressure release device motors and in contact with an axle or roller between opposite sides of a riser, said riser between said barrel and said harness said pressure release device being attachable to a rear portion of a wheelchair or a chair, the one or more motors receiving a signal from one or more relays to rotate the barrel in a first direction releasing a predetermined length of said one or more straps and a second direction retracting said one or more straps, the one or more relays receiving a control signal from logic configured to actuate said one or more relays;

b) causing the body part to move relative to its original position by automatically releasing or retracting the one or more straps being configured to move an occupant's torso between an upright position and a lower, bent-over position;

c) waiting for a first predetermined period of time; and d) returning the body and/or body part to its original position using the one or more motors.

18. The method of claim 17, wherein the first period of time is 30-120 seconds.

19. The method of claim 17, further comprising repeating steps b-d of the method after waiting for a second period of time.

20. The method of claim 19, wherein the second period of time is 15-90 minutes.

* * * * *